United States Patent [19]

Jaworski

[11] 4,307,881

[45] Dec. 29, 1981

[54] SIX BALL POOL RACK

[76] Inventor: John W. Jaworski, 8009 South Beloit, Bridgeview, Ill. 60455

[21] Appl. No.: 129,423

[22] Filed: Mar. 12, 1980

[51] Int. Cl.[3] ..... A63D 15/00

[52] U.S. Cl. ..... 273/22

[58] Field of Search ..... 273/22, 14, 6; 35/29 R; 272/137, 125

[56] References Cited

U.S. PATENT DOCUMENTS

| | | | |
|---|---|---|---|
| 854,799 | 5/1907 | Callahan | 273/22 |
| 1,167,137 | 1/1916 | Treiber | 273/22 |
| 4,005,861 | 2/1977 | Tomczak | 273/22 |
| 4,183,523 | 1/1980 | Hecht | 273/22 |

*Primary Examiner*—Richard C. Pinkham
*Assistant Examiner*—T. Brown
*Attorney, Agent, or Firm*—Laff, Whitesel, Conte & Saret

[57] ABSTRACT

A six ball pool rack is constructed having a frame defining two separate compartments. Each compartment is generally kidney-shaped and holds three pool balls in tangential relationship on a pool table. The compartments are joined by a center portion of the frame which separates the two groups of three balls and has indicator indicia imprinted thereon.

3 Claims, 4 Drawing Figures

SIX BALL POOL RACK

This invention relates to accessories for the game of pool and, more particularly, to a six ball pool rack designed for trick shots.

BACKGROUND

The game of pool, also called pocket billiards, involves the use of a table with six pockets located along the periphery of a table, a number of balls positioned on the table, and two or more players each using a stick to propel the balls. One particular ball, the cue ball, is propelled by a player toward another ball on the table. The object of the game is to drive the balls other than the cue ball into the pockets. Many variations of the game are commonly played.

The most popular size tables are rectangular and range from five to ten feet long, and from two and one-half to five feet wide. Most tables used in this country have table surfaces with lengths which are twice their width. The balls are generally about two and one-quarter inch in diameter.

To begin the game, the balls are usually grouped within a triangularly shaped rack, with the position of the rack on the table and the initial starting point of the cue ball being determined by markings on the table. After the balls are properly aligned, the rack is removed and one player propels the cue ball into the other balls. The players take turns using the cue ball to drive the other balls into the pockets until none of the balls except the cue ball are left.

Usually, the cue ball is used to drive another ball directly into the pocket. Sometimes, the cue ball is first bounced off the sides or cushions of the table before striking the other balls, or the cue ball is used to propel a first ball into one or more other balls before one ball is eventually driven into the pocket. Rarely, however, does more than one ball fall into a pocket with a single stroke of the stick, unless a very experienced or lucky player is involved. Even then, it is seldom that more than two or perhaps three balls are driven into pockets at one time.

Pool is a game which lends itself to trick shots. One such trick shot is described in a book entitled *Inside Pocket Billiards* by Steve Mizerak, published by Contemporary Books, Inc. in 1973. This book describes, among other things, a particular trick shot in which six balls are each driven simultaneously into one of the six pockets on the table. The balls are divided into two groups of three in which the middle balls in each group are positioned close enough together so that the cue ball cannot pass through. The book describes the middle balls as being placed halfway between the side pocket and the diamond on the table, in the center of the table. The end balls are described as touching the middle balls but angled toward the corner pockets. Upon hitting the cue ball below center and using a hard stroke, the six balls are each supposed to fall into different pockets on the table. However, an ordinary pool player will not be able to make this shot consistently, if at all, from merely a written description of the shot or by observing another perform the shot. This is due to the difficulty in accurately aligning the balls by eye.

SUMMARY OF THE INVENTION

The present invention provides a means for easily and repeatedly performing this shot without the need for aligning the balls by eye.

In keeping with one aspect of this invention, a rack is constructed with a frame defining two compartments, each compartment formed to define a kidney-shaped region for holding three balls in tangential relationship on the pool table. The two compartments are joined by a center portion of the frame so that the overall outline of the frame is butterfly shaped. The frame also includes an arrow imprinted on the center portion to permit proper positioning of the rack relative to the table surface.

The above mentioned and other features of this invention and the manner of obtaining them will become more apparent, and the invention itself will be best understood by reference to the following description of an embodiment of the invention taken in conjunction with the accompanying drawings.

BRIEF DESCRIPTION OF THE DRAWINGS

As shown in FIG. 1, a six ball pool rack constructed in accordance with the teachings of this invention comprises a frame 20 having two kidney-shaped compartments 22 and 24. Each compartment is of sufficient size to contain three pool balls in tangential relationship, as best shown in FIG. 3, wherein balls marked as 10, 11 and 12 are shown in compartment 22 and balls marked as 13, 14 and 15 are shown in compartment 24. When the frame is properly constructed, the imaginary line formed by joining the centers of balls 10 and 11 with the imaginary line formed by joining the centers of balls 11 and 12 defines an angle A of approximately 140 degrees. The same size angle B is formed by the centers of balls 13, 14 and 15 in compartment 24.

The frame also has a center portion 26 joining compartments 22 and 24. The center portion is of a width equal to or less than the diameter of a pool ball and separates the two sets of balls within the frame. The center portion preferably includes an arrow 28 or other indication means to designate the center or longitudinal axis of the frame. The arrow 28 points in a direction parallel to the sides of the table and in the same direction that the pool player will be shooting.

Figure 4:
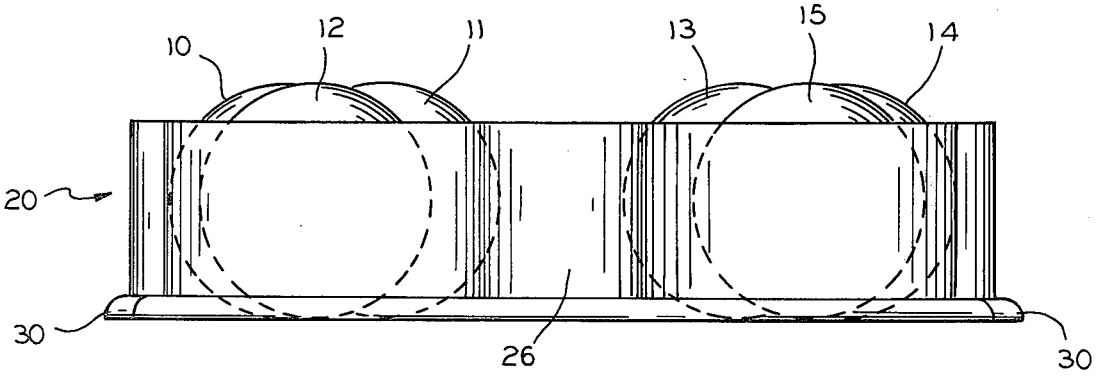
FIG. 4 is an end view of the invention.

As best shown in FIG. 4, the frame desirably includes a rim 30 extending along the entire outside bottom edge of the frame. The rim permits the player using the rack to more easily slide it along the pool table surface.

The frame is preferably constructed out of wood or molded plastic, but any suitably rigid material will do. In the preferred design, the frame is approximately two inches high and three-eighths of an inch in thickness. The center portion ranged in width from one and one-quarter inches at its most narrow point, which is between balls 11 and 14, to one and seven-eighths inches at its widest points, between balls 10 and 13 and between balls 12 and 15.

Figure 1:
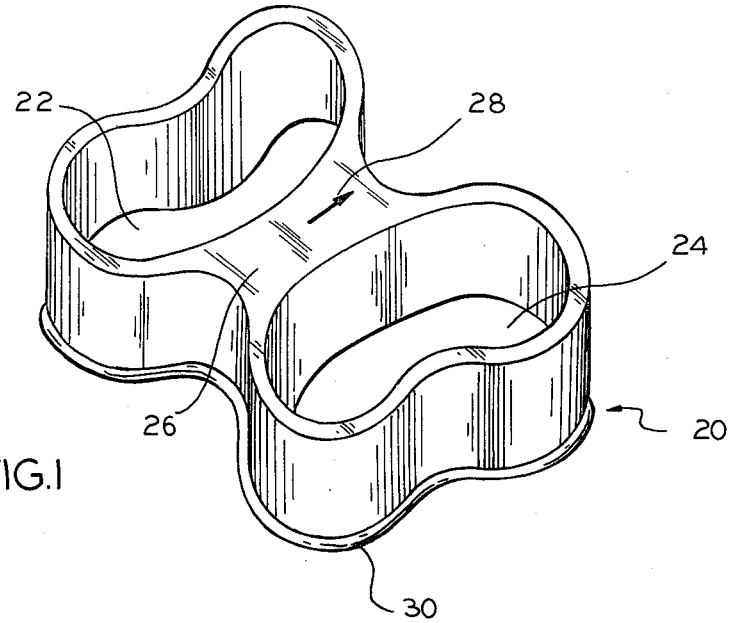
FIG. 1 is a perspective view of the invention.
Figure 2:
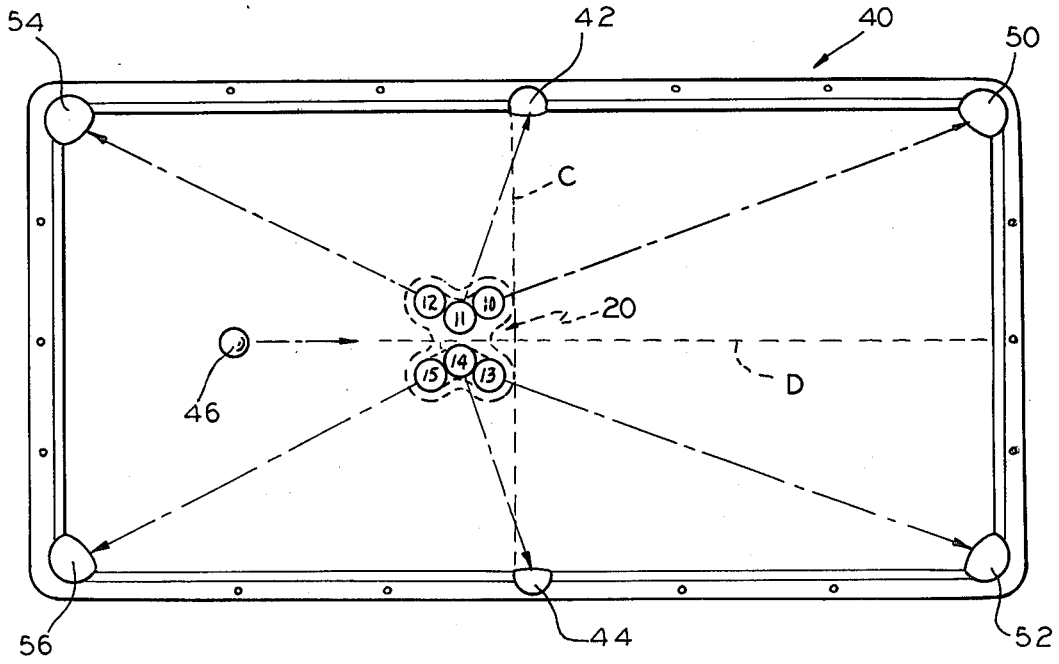
FIG. 2 shows the arrangement of the pool balls on the pool table when they have been properly positioned by the invention.
Figure 3:
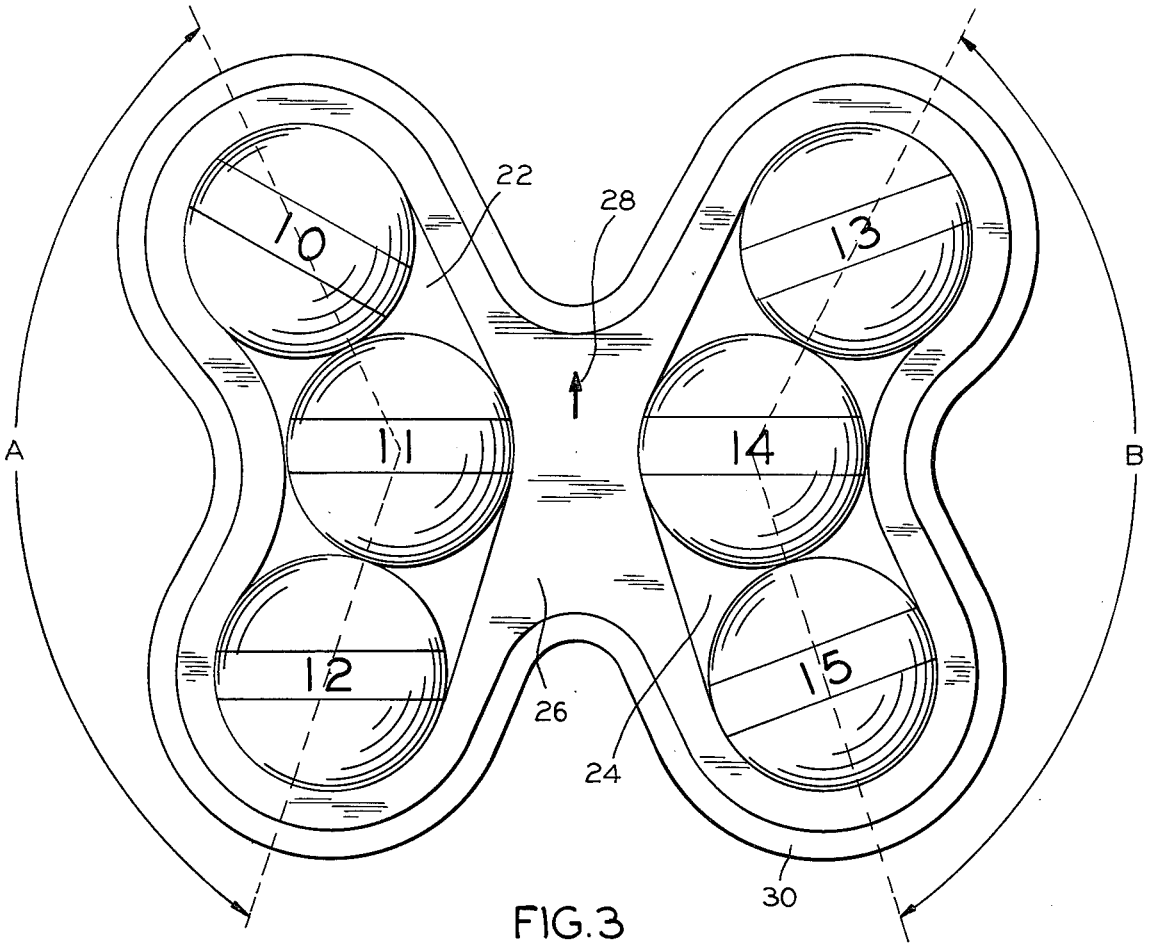
FIG. 3 is a plan view of the invention containing six pool balls.

FIG. 2 shows how the invention is used on a pool table 40. Assuming that a pool table of five feet in length and two and one-half feet in width is used, frame 20 is positioned on table 40 with the front end of the frame along imaginary line C joining the ends of side pockets 42 and 44. Arrow 28 is colinear with the imaginary line D defining the longitudinal axis of the table. On most pool tables, this axis is indicated by two markings printed on the table surface. The cue ball 46 is placed anywhere along line D so that frame 20 lies between it and line C. The six balls 10, 11, 12, 13, 14 and 15 are placed within the frame, three in each compartment. The frame is then removed from the table so as not to disturb the positions of the balls. The center portion 26 of the frame will have left a space or alley between the two sets of balls toward which the cue ball is directed by a player. Upon striking middle balls 11 and 14 with the cue ball, the front balls 10 and 13 will be propelled into corner pockets 50 and 52, respectively; the middle balls 11 and 14 will be propelled into side pockets 42 and 44, respectively; and rear balls 12 and 15 will be propelled into corner pockets 54 and 56, respectively.

If larger pool tables are used, the position of frame 20 with the six balls should be adjusted slightly on the table. On a six foot long pool table, the front of the frame should be positioned about one-eighth of an inch behind line C. On seven, eight, nine and ten foot long pool tables, the frame should be positioned about one and one-quarter inches, one and one-half inches, one and three-quarter inches, and two inches, respectively, behind line C. In each example, it is assumed that the pool table has the usual width of about one-half the length.

The invention permits even a novice pool player to easily make an apparently difficult shot time and again. A minimum of visual alignment and guesswork as to the position of the balls is involved, and the entire shot can reliably be set up and performed in a very short period of time as compared with the wholly visual, trial-and-error method previously used.

While the principles of the invention have been described above in connection with specific apparatus and applications, it is to be understood that this description is made only by way of example and not as a limitation on the scope of the invention.

I claim:

1. A device for positioning six standard size pool balls on a pool table in preparation for a trick shot comprising: a frame having two compartments, each of said compartments being and adapted to retain three pool balls in tangential relationship on the pool table, said frame also having a center portion in contact with one of said balls in each compartment, said center portion separating said compartments and defining an alley between the two sets of three balls wherein the sets of balls are spaced apart when the rack is removed without disturbing said balls.

2. A device as described in claim 1, wherein said center portion includes indicator means for aligning the longitudinal axis of the device parallel to the sides of the table.

3. A device as described in claim 1, wherein each said compartment is constructed so that an imaginary line joining the centers of the a first ball and a second ball in each compartment defines an angle of approximately 140 degrees with an imaginary line joining the centers of said second and a third balls.

* * * * *

UNITED STATES PATENT AND TRADEMARK OFFICE

CERTIFICATE OF CORRECTION

PATENT NO. : 4,307,881

DATED : December 29, 1981

INVENTOR(S) : John W. Jaworski

It is certified that error appears in the above—identified patent and that said Letters Patent is hereby corrected as shown below:

Column 4, Line 15, "and" should be deleted

Signed and Sealed this

*Eighteenth* Day of *May 1982*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,307,881

DATED : December 29, 1981

INVENTOR(S) : John W. Jaworski

It is certified that error appears in the above—identified patent and that said Letters Patent is hereby corrected as shown below:

Column 4, Line 29, the second "the" should be deleted

Column 4, Line 32, "balls" should be --ball--

Signed and Sealed this

*Twenty-seventh* Day of *July 1982*

[SEAL]

*Attest:*

GERALD J. MOSSINGHOFF

*Attesting Officer* *Commissioner of Patents and Trademarks*